United States Patent [19]

Wilson et al.

[11] Patent Number: 4,878,373

[45] Date of Patent: Nov. 7, 1989

[54] PEEL ASSEMBLY FOR AN INGOT MANIPULATOR

[75] Inventors: Geoffrey Wilson; Trevor Hemingway, both of Sheffield, England

[73] Assignee: Dave McKee (SHeffield) Limited, Yorkshire, England

[21] Appl. No.: 269,738

[22] PCT Filed: Mar. 2, 1988

[86] PCT No.: PCT/GB88/00153

§ 371 Date: Nov. 2, 1988

§ 102(e) Date: Nov. 2, 1988

[87] PCT Pub. No.: WO88/06499

PCT Pub. Date: Sep. 7, 1988

[30] Foreign Application Priority Data

Mar. 3, 1987 [GB] United Kingdom ..... 8704931

[51] Int. Cl.[4] ..... B21D 43/10; B21J 13/12

[52] U.S. Cl. ..... 72/420; 72/422

[58] Field of Search ..... 72/420, 422; 414/753, 414/744 A

[56] References Cited

U.S. PATENT DOCUMENTS

| | | | |
|---|---|---|---|
| 1,881,169 | 10/1932 | Brosius | 414/753 |
| 3,126,770 | 3/1964 | Wuppermann et al. | 72/420 |
| 3,773,189 | 11/1973 | Kitamura et al. | 414/753 |
| 4,776,199 | 10/1988 | Schubert | 72/422 |
| 4,815,311 | 3/1989 | Schubert | 72/422 |

FOREIGN PATENT DOCUMENTS

| | | | |
|---|---|---|---|
| 16231 | 7/1986 | Japan | 72/422 |
| 189836 | 8/1986 | Japan | 72/422 |
| 580053 | 11/1977 | U.S.S.R. | 72/422 |
| 866884 | 5/1961 | United Kingdom . | |

*Primary Examiner*—Robert L. Spruill

*Attorney, Agent, or Firm*—Lee, Mann, Smith, McWilliams & Sweeney

[57] ABSTRACT

A peel assembly for a manipulator comprises an outer housing (25) surrounding an inner housing (19) in which a shaft (1) is rotatably mounted. The inner housing (19) is slidable in the direction of its length relative to the outer housing (25) and the shaft (1) is rotatable with respect to the inner housing (19). The shaft (1) carries an enlarged head (3) having a pair of jaws (9) for gripping an ingot.

10 Claims, 2 Drawing Sheets

PEEL ASSEMBLY FOR AN INGOT MANIPULATOR

Manipulators for manipulating metal ingots, particularly during forging operations, are well known. These manipulators usually comprise some form of wheeled carriage supporting a peel assembly which, in turn, supports the ingot in cantilever fashion. The ingot is gripped by at least two co-operating jaws which are pivotally secured to a head at one end to position the supported ingot in a desired angular position.

It is an object of the present invention to provide a peel assembly for a manipulator which is of improved construction.

According to the present invention, a peel assembly for a manipulator comprises an elongate shaft having an enlarged head at one end thereof and at least two co-operating jaws pivotally secured to the head; an elongate inner housing surrounding part of the shaft and carrying bearings which support the shaft for angular rotation about its longitudinal axis; an elongate outer housing fitted around the inner housing so as to prevent relative rotation therebetween and with co-operating surfaces on the two housings which permit the inner housing to slide in the direction of its length relative to the outer housing; first drive means for rotating the shaft about its longitudinal axis and second drive means connected to the inner housing for sliding the inner housing and the shaft relative to the outer housing.

The first drive means is conveniently an electric or hydraulic motor driving a pinion which is permanently meshed with a gear mounted on a splined portion of the elongate shaft. In this way, rotation can be applied to the shaft even when the shaft has been displaced in the direction of its length.

Alternatively, the gear wheel is fixed to the shaft and the pinion is enlarged in the direction of movement of the shaft to accommodate movement of the shaft.

The second drive means for sliding the inner housing relative to the outer housing conveniently takes the form of one or more piston-cylinder devices mounted on the outer housing and with the piston rods connected through a crosshead or collar to one end of the inner housing. By displacing the inner housing, the shaft is also displaced in the direction of its length.

The elongate shaft conveniently has an axial bore and a rod is positioned in the bore and connected at one end to the co-operating jaws and means is provided on the opposite end of the shaft for displacing the rod in the direction of its length in order to actuate the jaws between an open position and a position in which an ingot can be gripped between them.

The inner and outer housings are of any convenient cross-section with the outer surface of the inner housing and the inner surface of the outer housing providing co-operating surfaces which enable the inner housing to slide in the direction of its length relative to the outer housing but prevent relative rotation. The co-operating surfaces on the two housings may be arranged on the sides of a rectangle or they may be arranged on the sides of a triangle.

In order that the invention may be more readily understood, it will now be described, by way of example only, with reference to the accompanying drawings, in which.

Figure 1:
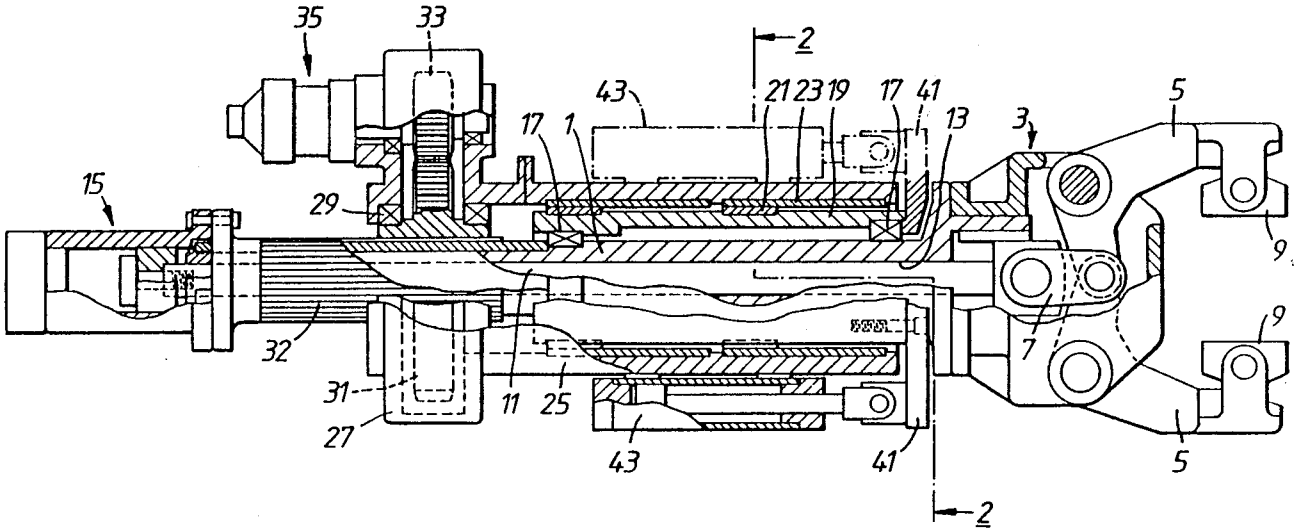
FIG. 1 is a side elevation, partly in section, of a peel assembly for a manipulator.
Figure 2:
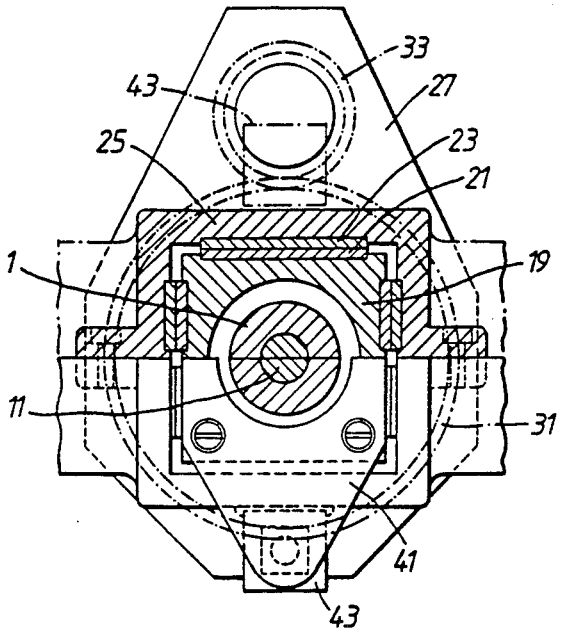
FIG. 2 is a section on the line 2—2 of FIG. 1.

A peel assembly for a manipulator for manipulating metal ingots comprises an elongate hollow shaft 1 having an enlarged head 3 at one end. A pair of bell crank levers 5 are pivotally mounted on the head 3 and one end of each bell crank lever is pivotally connected to a coupling 7. The other end of each bell crank lever carries a jaw 9 and the jaws co-operate together to grip an ingot placed between them when the two bell crank levers are pivoted by axially displacing a rod 11 connected to the coupling 7 and extending through the axial bore 13 of the shaft 1. A piston-cylinder assembly 15 is mounted on the end of the shaft 1 which is opposite the enlarged head and the assembly is connected to the rod 11 to displace it in the direction of its length.

The shaft 1 carries a pair of bearings 17 at spaced intervals on its outer periphery and these bearings are fitted in an elongate inner housing 19 which surrounds part of the shaft. The outer periphery of the inner housing is of rectangular cross-section and its outer faces are provided with replaceable wear plates 21. These wear plates 21 co-operate with further wear plates 23 provided on the inside surface of an outer housing 25. The inside surfaces are also of rectangular cross-section. The wear plates provide surfaces which enable the inner housing to slide in the direction of its length relative to the outer housing. However, since the housings are of rectangular cross-section, rotation of one housing relative to the other is not permitted.

The outer housing 25 extends for a greater axial length than the inner housing 19 and at the end away from the head 3 it carries a casing 27 which carries bearings 29 into which an internally splined gear wheel 31 is positioned. The gear wheel 31 is fitted on to a splined portion 32 of the shaft 1. The splines permit the shaft to be moved in the direction of its length relative to the gear wheel 31. The gear wheel is permanently meshed with a pinion 33 rotatably mounted in the casing and driven by an external drive motor 35 which may be an electric motor or a hydraulic motor.

A crosshead or a pair of plates 41 are secured, by bolts, to the end of the inner housing which is adjacent the enlarged head 3. A pair of piston-cylinder devices 43 are mounted on the outside of the outer housing and their piston rods are pivotally connected to these plates 41. When fluid under pressure is introduced into the piston-cylinder devices, the piston rods displace the inner housing and the shaft rotatably supported by it in the direction of the length of the shaft by sliding the inner housing relative to the outer housing. The plates 41 may be integral with the housing 19.

The shaft carrying the jaws 9 is thus rotatable about its longitudinal axis through the drive motor 35 and the bear and pinions 31, 33 and the shaft carrying the jaws can be displaced in the direction of its length by way of the piston-cylinder devices 43 acting through the crosshead or plates 41.

Figure 3:
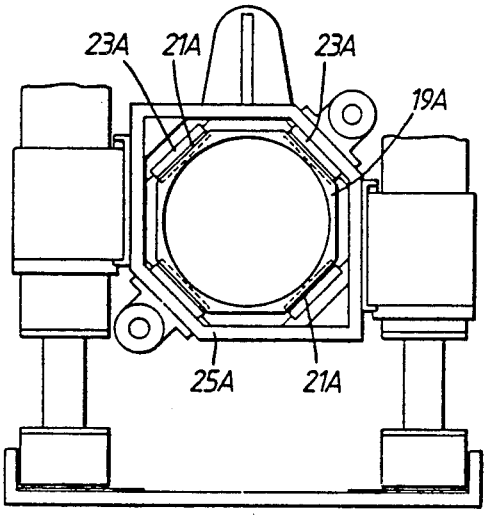
FIG. 3 is an elevation, similar to Figure 2, but showing an alternative embodiment.

In the alternative arrangement shown in FIG. 3, the outer surfaces of the inner housing 19A is of octagonal cross-section and four alternate surfaces of the housing carry wear plates 21A. The inner surface of the outer housing 25A is of six-sided cross-section, although not a regular hexagon, and, internally of the housing, there are four wear plates 23A which co-operate with the wear plates 21A to enable the inner housing 19A to slide axially with respect to the outer housing 25A. The construction shown in FIG. 3 gives a more precise location of the inner housing within the outer housing.

The versatile peel assembly is of compact construction and can readily be mounted on a wheeled carriage.

We claim:

1. A peel assembly for a manipulator comprising an elongate shaft having an enlarged head at one end thereof and at least two co-operating jaws pivotally secured to the head;

an elongate inner housing surrounding part of the shaft and carrying bearings which support the shaft for angular rotation about its longitudinal axis;

an elongate outer housing fitted around the inner housing so as to prevent relative rotation therebetween and with co-operating surfaces on the two housings which permit the inner housing to slide in the direction of its length relative to the outer housing;

first drive means for rotating the shaft about its longitudinal axis and second drive means connected to the inner housing for sliding the inner housing and the shaft relative to the outer housing.

2. A peel assembly as claimed in claim 1, in which the co-operating surfaces on the two housings are arranged on the sides of a rectangle.

3. A peel assembly as claimed in claim 1, in which the co-operating surfaces on the two housings are arranged on the sides of a triangle.

4. A peel assembly as claimed in claim 2 or 3, in which the co-operating surfaces are provided by wear plates secured to the respective housings.

5. A peel assembly as claimed in claim 1, in which the first drive means comprises an electric or hydraulic motor in driving relation with a pinion which is permanently meshed with a gear wheel mounted on the shaft.

6. A peel assembly as claimed in claim 5, in which the gear wheel is mounted on a splined portion of the elongate shaft.

7. A peel assembly as claimed in claim 5, in which the gear wheel is fixed to the shaft and the pinion is enlarged in the direction of movement of the shaft to accommodate movement of the shaft.

8. A peel assembly as claimed in claim 1, in which the second drive means comprises one or more piston-cylinder devices connected to the inner housing.

9. A peel assembly as claimed in claim 8, in which the or each piston-cylinder device is mounted on the outer housing and has its piston connected to a crosshead or collar on one end of the inner housing.

10. A peel assembly as claimed in claim 1, in which each jaw is mounted on one end of a separate bell crank lever pivotally mounted on the head and the other end of each bell crank lever is connected to a rod extending through a bore in the shaft and means are provided on the end of the shaft opposite to the head to displace the rod in the direction of its length and thereby pivot the bell crank levers.

* * * * *